US007516858B2

(12) United States Patent
Willim

(10) Patent No.: US 7,516,858 B2
(45) Date of Patent: Apr. 14, 2009

(54) CRANE BOOM

(75) Inventor: Hans-Dieter Willim, Ulm-Unterweiler (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 5 days.

(21) Appl. No.: 11/270,521

(22) Filed: Nov. 10, 2005

(65) Prior Publication Data

US 2006/0096940 A1 May 11, 2006

(30) Foreign Application Priority Data

Nov. 16, 2004 (DE) ..... 20 2004 017 771

(51) Int. Cl.
*B66C 23/69* (2006.01)

(52) U.S. Cl. ..... 212/300; 212/168; 212/239; 212/262

(58) Field of Classification Search ..... 212/299, 212/300, 168, 239, 262
See application file for complete search history.

(56) References Cited

U.S. PATENT DOCUMENTS

| | | | | |
|---|---|---|---|---|
| 4,383,616 | A * | 5/1983 | Sterner et al. | 212/299 |
| 4,529,094 | A * | 7/1985 | Wadsworth | 212/255 |
| 4,573,593 | A | 3/1986 | Lietzau | |
| 6,550,624 | B1 * | 4/2003 | Irsh et al. | 212/299 |
| 7,137,518 | B2 * | 11/2006 | Irsch et al. | 212/299 |
| 2002/0070187 | A1 * | 6/2002 | Willim | 212/299 |
| 2004/0129663 | A1 | 7/2004 | Willim | |

FOREIGN PATENT DOCUMENTS

| | | | |
|---|---|---|---|
| DE | 2118265 | | 11/1972 |
| DE | 2827088 | | 1/1980 |
| DE | 33 40 845 | C1 | 6/1985 |
| DE | 29720972 | | 3/1999 |
| DE | 199 29 549 | A1 * | 1/2001 |
| DE | 200 20 974 | U1 | 4/2002 |
| DE | 202 19 126 | U1 | 4/2004 |

* cited by examiner

*Primary Examiner*—Thomas J. Brahan
(74) *Attorney, Agent, or Firm*—Jacobson Holman PLLC

(57) ABSTRACT

The present invention relates to a crane boom, in particular a telescopic boom of a mobile crane, comprising a boom guying which has at least one guy rope which is guided from an inner articulation point in the region of a boom articulation point to an outer articulation point in the region of a projecting boom part. In accordance with the invention, the guy rope is articulated at its outer end such that the guy rope force induces a bending moment in the crane boom which counters the sagging of the crane boom. This can be achieved in that the guy rope is articulated eccentrically from the boom part. In accordance with the invention, the outer articulation point of the guy rope is arranged spaced apart from the boom part at an articulation jib which is secured to the boom part such that a tensile force of the guy rope induces a bending moment into the crane boom via the articulation jib, said bending moment reducing the bending moment generated in the boom by a hook load and the boom's own weight. The articulation jib which projects transversely to the longitudinal boom axis forms a bending moment jib, so to say, which is secured to the outer end of the crane boom or to one of the outer boom parts such that a bending moment reducing the sagging of the crane boom is generated in the crane boom by the guying force via the articulation jib.

14 Claims, 2 Drawing Sheets

CRANE BOOM

Figure 1:
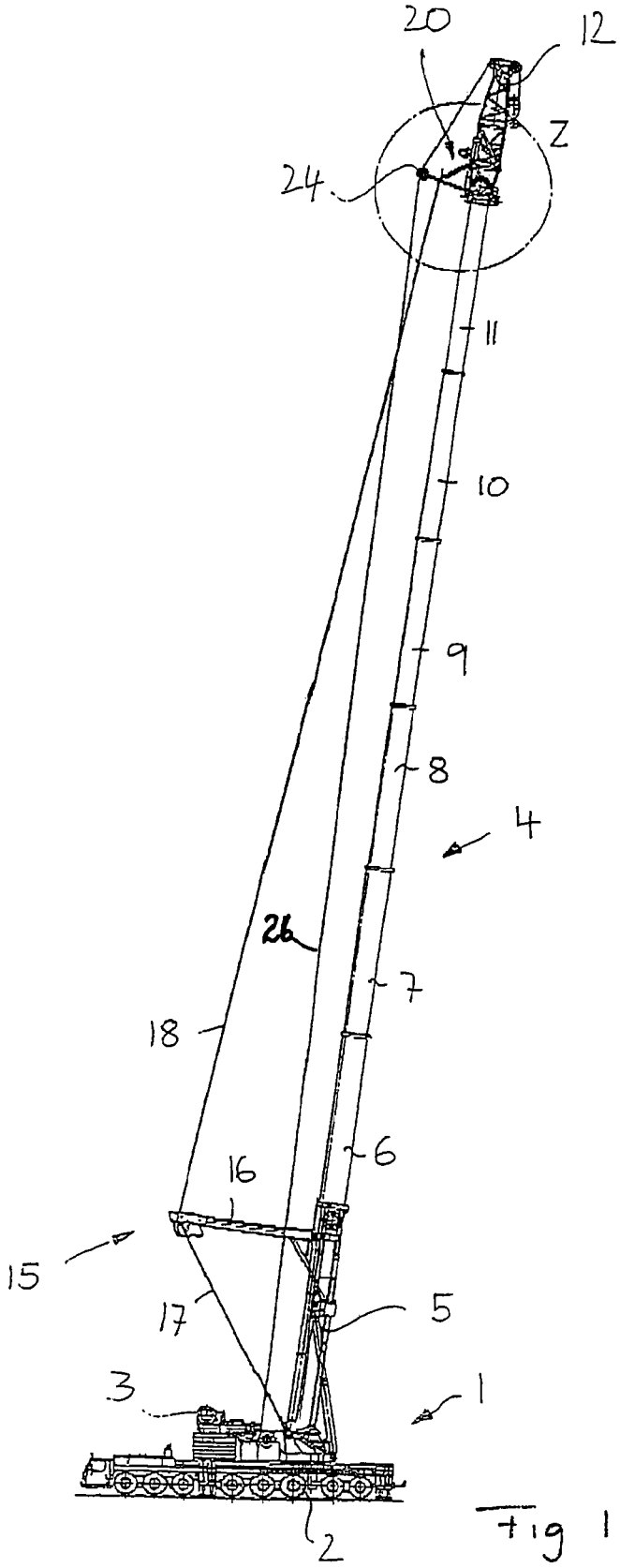

The invention relates to a crane boom, in particular to a telescopic boom of a mobile crane, comprising a boom guying which has at least one guy rope which is guided from an inner articulation point in the region of a boom articulation piece to an external articulation point in the region of a projecting boom part.

Telescopic booms of mobile cranes are guyed with the help of one or more guy ropes in order to be able to lift higher working loads. The guy rope is supported in the region of an articulated section or also of a telescopic section which can be traveled out thereof and is connected to the tip of the telescopic boom or to the collar of the innermost telescopic section, with it also already having been proposed to deflect the guy rope at the connection point by means of a reel and to guide it in doubled-up fashion, so-to-say. Since the guy supports cannot be made with any desired length, the guy rope always runs toward its outer connection point at a more or less acute angle with respect to the longitudinal axis of the boom so that boom sagging can also occur at very high guy rope forces.

It is the underlying object of the present invention to provide an improved crane boom of the named kind which avoids disadvantages of the prior art and further develops it in an advantageous manner. The boom guying should preferably be optimized such that higher working loads can be moved.

This object is solved in accordance with the invention by a crane boom in accordance with claim 1. Preferred aspects of the invention are the subject of the dependent claims.

In accordance with the invention, the guy rope is therefore articulated at its outer end such that the guy rope force induces a bending moment in the crane boom which counters the sagging of the crane boom. This can be achieved in that the guy rope is articulated in an eccentric manner from the boom part. In accordance with the invention, the outer articulation point of the guy rope is spaced apart from the boom part at an articulation jib which is secured to the boom part such that a tensile force of the guy rope introduces a bending moment into the crane boom via the articulation jib, said bending moment reducing the bending moment in the boom generated by a hook load and by the boom's own weight. The articulation jib projecting transversely to the longitudinal direction of the boom so-to-say forms a bending moment jib which is secured to the outer end of the crane boom or to one of the outer boom parts such that a bending moment reducing the sagging of the crane boom is generated from the guy rope force in the crane boom via the articulation jib.

The articulation jib is in particular arranged on an upper side of the boom remote from the crane load hook so that the bending moment induced via the articulation jib counters a moment in the boom generated by the hook load and the boom's own weight in a favorable manner.

In a further development of the invention, a hoist rope of the crane is guided over the articulation jib by means of suitable deflection means, in particular by a pulley, such that a hoist rope force likewise induces a bending moment into the crane boom via the articulation jib. This additional countermoment can further reduce the sagging of the boom and thus permit even higher working loads.

The deflection means are arranged at a suitable section of the articulation jib in dependence on the space conditions in order to permit a collision-free deflection of the hoist rope. In accordance with an advantageous embodiment of the invention, the deflection means for the hoist rope are arranged at a section of the moment jib projecting further than the articulation point of the guy rope.

The articulation jib itself can generally be made in different manners. To be able to nevertheless introduce high moments with an embodiment of the articulation jib of light construction, the articulation jib consists, in accordance with an advantageous embodiment of the invention, of at least one tension strut and at least one compression strut which are connected to one another in the manner of a dual connection and are articulated at the respective boom part at points spaced apart from one another. Due to the dual-connection type design of the articulation jib, a bending stress of the moment jib itself is avoided. The struts are only under tensile or compressive stress, whereby an arrangement of light construction is also achieved with high forces to be transmitted.

The height of the articulation jib is selected such that a bending moment of a desired magnitude is generated in the crane boom at the tensile forces occurring in the guy rope. Favorable conditions can be achieved in accordance with an embodiment of the invention in that the articulation jib has a height which is greater than the cross-section of the boom part at which the articulation jib is secured. The height of the articulation jib and thus the spacing of the articulation point of the guy rope from the respective boom part, however, preferably does not exceed twice its diameter. Depending on the boom configuration and on the guying geometry, the articulation jib can also have a greater or lower height than that named. Dimensioning in the recited range will, however, bring along advantageous levering ratios for may crane geometries.

The guying is in particular advantageous with telescopic booms of mobile cranes. The articulation jib can here preferably be secured to the collar of the innermost telescope section and/or to a boom extension articulation piece secured thereto.

In a further development of the invention, the guy rope is supported in a manner known per se with respect to the articulation piece of the boom by a guy support which is supported at the boom articulation piece or at a boom piece adjoining it, in particular at the collar of an articulation section. The length of this guy support will as a rule amount to a multiple of the previously described articulation piece.

In order also to achieve a lateral guying of the crane boom, the guying can have a spatial design overall. In this connection, two guy supports spread apart in a V shape can support two guy ropes which are advantageously articulated in the previously described manner to an outer boom part at an articulation jib. As required, two separate bending moment jibs can also be provided which can each articulate one of the guy ropes and be connected to one another by a transverse connection.

Figure 2:
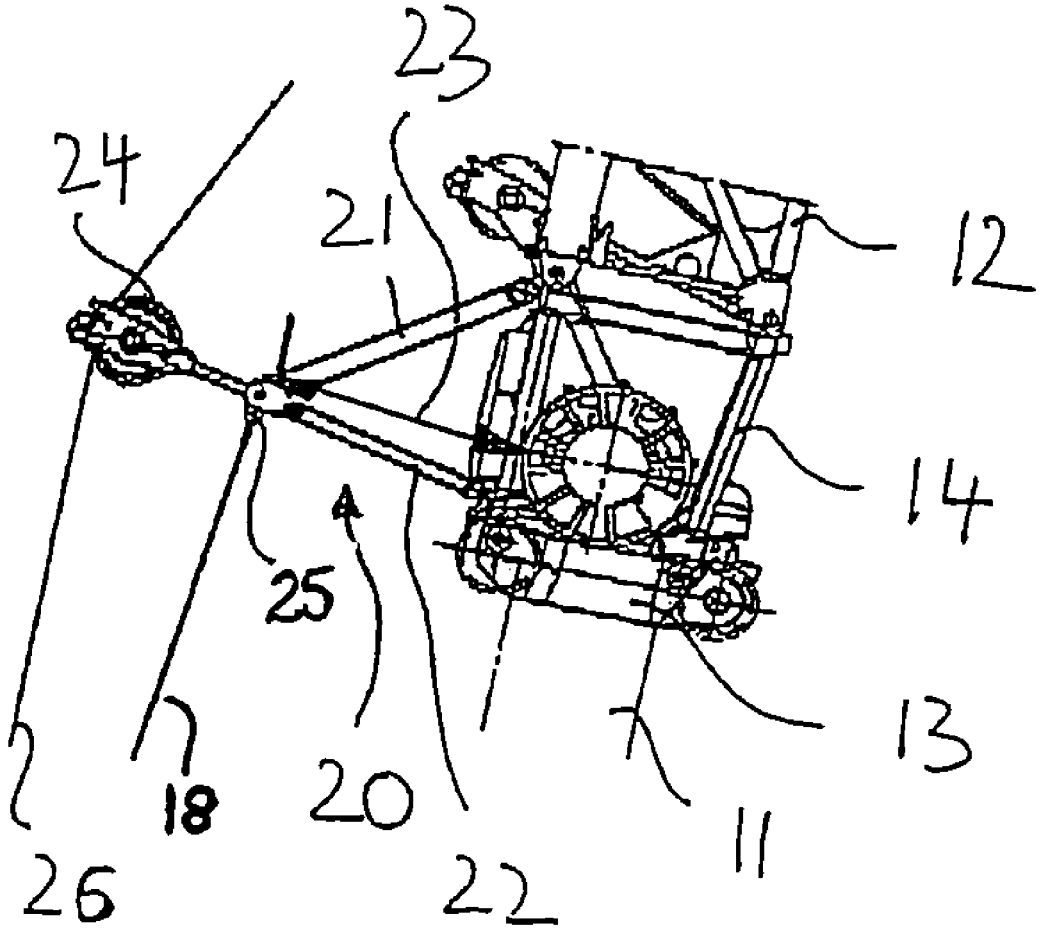

The invention will be described in the following with reference to a preferred embodiment and to associated drawings. There are shown in the drawings:

FIG. 1: a side view of a mobile crane comprising a telescopic boom in an erect position which is guyed by a boom guying; and FIG. 2: an enlarged sectional representation of the region of the crane boom marked with a Z in FIG. 1 at which the guy rope is eccentrically articulated.

The mobile crane 1 shown in the Figures has an undercarriage 2 made as a truck in a manner known per se on which a revolving superstructure 3 rotatable about an upright axis is supported. The revolving superstructure 3 bears a telescopic boom 4 which can be luffed about a horizontal axis and has an articulation section 5 articulated at the revolving superstructure 3 and a plurality of telescopic sections 6 to 11 which can be telescoped out of it.

A boom extension in the form of a lattice tip 12 which can optionally also be formed as a luffing tip is secured to the innermost telescopic section 11 and indeed by means of a boom extension articulation piece 14 bolted to the collar 13 of the telescopic section 11.

As FIGS. 1 shows, the telescopic boom 4 is guyed by mans of a boom guying 15 which can be made as a spatial Y-pattern guying known per se. Two guy supports are provided at the articulation section 5 which can be put in an upright position, are spread apart in a V shape in the operating position and are guyed via guy ropes 17 and 18 or a corresponding guy linkage system at the foot of the articulation section 5. Guy ropes 18 furthermore run toward the tip of the telescopic boom 4 from the guy supports 16.

As FIG. 2 shows, the guy ropes 18 are articulated in the region of the collar 13 of the innermost telescopic section 11 by means of an articulation jib 20 which provides an eccentric articulation of the guy ropes 18 at the outer boom end or at the innermost telescopic section. In the embodiment drawn, the articulation jib 20 is secured to the boom extension articulation piece 14. In the embodiment drawn, it consists of a dual connection comprising a tension strut 21 and a compression strut 22 which are connected to one another at one end and are articulated to the boom extension articulation piece 14 at points spaced apart from one another at the other end.

In the embodiment drawn, the guy ropes 18 are connected to the articulation jib 20 approximately in the region of the connection of the tension struts and compression struts 21 and 22. It is, however, understood that the guy ropes 18 are optionally also only deflected there and could ultimately be connected to the boom itself, whereby a similar effect would result.

As FIG. 2 shows, the height 23 of the articulation jib 20 is a little larger between the upper side of the boom and the articulation point of the guy ropes 18 than the diameter measurement of the innermost telescopic section 11.

The articulation jib 20 furthermore bears a pulley 24 which lies above the articulation point 25 of the guy ropes 18. The hoist rope 26 of the crane is guided via this pulley 24 such that the rope force of the hoist rope 26 also induces a bending movement into the telescopic boom 4 via the articulation jib 20.

The invention claimed is:

1. A mobile crane comprising a telescopic boom assembly which includes one or more telescopic boom sections, said boom assembly being pivotably supported at a boom articulation section (5) to be luffed about a horizontal axis, further comprising a boom guying (15) which has at least one guy rope (18) said boom guying (15) having an inner end fixed in the region of said horizontal axis and an outer end connected adjacent a tip of the telescopic boom assembly or a collar of an innermost telescopic section thereof, wherein said boom guying is supported between its inner end and its outer end by a guying support (16) extending from said telescopic boom assembly (4) at a location between said horizontal axis and said telescopic boom assembly tip, and said guy rope (18) of said boom guying is fixed at an outer end to a bending moment jib (20) that projects from an upper side of the telescopic boom assembly (4) transversely to the longitudinal boom axis in the direction of luffing of said boom assembly, said bending moment jib (20) rigidly secured to said telescopic boom assembly at points spaced apart in the longitudinal direction of said telescopic boom assembly (4), wherein said at least one guy rope is connected to said bending moment jib (20) at a point spaced apart from said upper side of the boom assembly in the luffing direction thereof such that a tensile force of the guy rope (18) induces a bending moment in the crane boom via the bending moment jib (20) to counter bending moments generated by the telescopic boom assembly and a load thereon.

2. A crane boom in accordance with claim 1, wherein said bending moment jib (20) projects from said upper side of the boom assembly in a direction remote from a hook load such that the bending moment induced via the bending moment jib (20) counters a load moment induced by a hook load.

3. A crane boom in accordance with claim 1, further comprising a hoist rope that is guided via the bending moment jib (20) by a deflection means (24) such that a hoist rope force induces a counter bending moment into the crane boom assembly (4) via the bending moment jib (20).

4. A crane boom in accordance with claim 3, wherein said deflection means (24) is spaced further apart from the boom assembly than the articulation point (25) of the guy rope (18) at the bending moment jib (20).

5. A crane boom in accordance with claim 1, wherein the bending moment jib (20) length between its articulation point (25) for the guy rope (18) and said boom assembly is greater that the cross-section of said boom assembly (11).

6. (previously amended): A crane boom in accordance with claim 1, wherein the bending moment jib (20) is secured to the collar (13) ofan innermost telescopic section(l1) and/or to a boom extension articulation piece. (14) secured thereto.

7. A crane boom in accordance with claim 1, wherein the bending moment jib (20) comprises a tension strut (21) and a compression strut (22) each having first ends connected to one another and having second ends articulated at spaced-apart points on the telescopic boom assembly (11, 14).

8. A crane boom in accordance with claim 1, wherein the guy rope (18) is bolted to the bending moment jib (20).

9. A crane boom in accordance with claim 1, wherein the guy rope (18) is supported by a guy support (16) which is supported at the boom articulation section (5) or at the collar of an articulation section (5).

10. A crane boom in accordance with claim 1, wherein the boom guying (15) is of spatial design and has two guying ropes (18) which are supported via two guy supports (16) spread apart in V shape in the operating position and which are articulated at the other end in each case via the or a respective one bending moment jib (20).

11. A mobile crane comprising a telescopic boom assembly which includes one or more telescopic boom sections said boom assembly being pivotably supported at a boom articulation section (5) to be luffed about a horizontal axis, further comprising a boom guying (15) which has at least one guy rope (18) said boom guying (15) having an inner end fixed in the region of said horizontal axis and an outer end connected adjacent a tip of the telescopic boom assembly or a collar of an innermost telescopic section thereof, wherein said boom guying is supported between its inner end and its outer end by a guying support (16) extending from said telescopic boom assembly (4) at a location between said horizontal axis and said telescopic boom assembly tip, and said guy rope (18) of said boom guying is fixed at an outer end to a bending moment jib (20) that projects from an upper side of the telescopic boom assembly (4) transversely to the longitudinal boom axis in the direction of luffing of said boom assembly, said bending moment jib (20) comprising a tension strut (21) having a tension strut first end and second end, and a compression strut (22) having a compression strut first end and second end, said tension strut first end rigidly secured to said compression strut first end at a location spaced from said telescopic boom, said tension strut second end and said compression strut second end rigidly secured to said telescopic boom assembly at spaced-apart locations on said telescopic boom assembly with said tension strut second end connected closer to said telescopic boom assembly tip than said compression strut second end, wherein said at least one guy rope is connected to said bending moment jib (20) at a point spaced apart from said upper side of the boom assembly in the luffing direction thereof such that a tensile force of the guy rope (18) induces a bending moment in the crane boom via the bending momentjib (20) to counter bending moments generated by the telescopic boom assembly and a load thereon.

12. A mobile crane comprising a telescopic boom assembly which includes one or more telescopic boom sections and a boom extension articulation piece (14) secured thereto, said boom assembly being pivotably supported at a boom articulation section (5) to be luffed about a horizontal axis, further comprising a boom guying (15) which has at least one guy rope (18) said boom guying (15) having an inner end fixed in the region of said horizontal axis and an outer end connected adjacent a tip of the telescopic boom assembly or a collar of an innermost telescopic section thereof, wherein said boom guying is supported between its inner end and its outer end by a guying support (16) extending from said telescopic boom assembly (4) at a location between said horizontal axis and said telescopic boom assembly tip, and said guy rope (18) of said boom guying is fixed at an outer end to a bending moment jib (20) that projects from an upper side of the telescopic boom assembly (4) transversely to the longitudinal boom axis in the direction of luffing of said boom assembly, said bending moment jib (20) rigidly secured to said boom extension articulation piece of said telescopic boom assembly at points spaced apart in the longitudinal direction of said telescopic boom assembly (4), wherein said at least one guy rope is connected to said bending moment jib (20) at a point spaced apart from said upper side of the boom assembly in the luffing direction thereof such that a tensile force of the guy rope (18) induces a bending moment in the crane boom via the bending moment jib (20) to counter bending moments generated by the telescopic boom assembly and a load thereon.

13. A crane boom in accordance with claim 12, wherein said bending momentjib (20) projects from said upper side of the boom assembly in a direction remote from a hook load such that the bending moment induced via the bending moment jib (20) counters a load moment induced by a hook load.

14. A mobile crane comprising a telescopic boom assembly which includes one or more telescopic boom sections and a boom extension articulation piece (14) secured thereto, said boom assembly being pivotably supported at a boom articulation section (5) to be luffed about a horizontal axis, further comprising a boom guying (15) which has at least one guy rope (18) said boom guying (15) having an inner end fixed in the region of said horizontal axis and an outer end connected adjacent a tip of the telescopic boom assembly or a collar of an innermost telescopic section thereof, wherein said boom guying is supported between its inner end and its outer end by a guying support (16) extending from said telescopic boom assembly (4) at a location between said horizontal axis and said telescopic boom assembly tip, and said guy rope (18) of said boom guying is fixed at an outer end to a bending moment jib (20) that projects from an upper side of the telescopic boom assembly (4) transversely to the longitudinal boom axis in the direction Of luffing of said boom assembly, said bending moment jib (20) comprising a tension strut (21) having a tension strut first end and second end, and a compression strut (22) having a compression strut first end and second end, said tension strut first end rigidly secured to said compression strut first end at a location spaced from said telescopic boom, said tension strut second end and said compression strut second end rigidly secured to said boom extension articulation piece of said telescopic boom assembly at spaced-apart locations with said tension strut second end connected closer to said telescopic boom assembly tip than said compression strut second end, wherein said at least one guy rope is connected to said bending moment jib (20) at a point spaced apart from said upper side of the boom assembly in the luffing direction thereof such that a tensile force of the guy rope (18) induces a bending moment in the crane boom via the bending moment jib (20) to counter bending moments generated by the telescopic boom assembly and a load thereon.

* * * * *